US006499249B1

(12) United States Patent
Luijkx

(10) Patent No.: US 6,499,249 B1
(45) Date of Patent: Dec. 31, 2002

(54) DEVICE AND METHOD FOR PRESENTING FRESH PRODUCTS

(76) Inventor: Cornelius Petrus Maria Luijkx, Dorsvlegel 10, 1648 HX De Goorn (NL)

( * ) Notice: Subject to any disclaimer, the term of this patent is extended or adjusted under 35 U.S.C. 154(b) by 0 days.

(21) Appl. No.: 09/675,118

(22) Filed: Sep. 28, 2000

Related U.S. Application Data

(63) Continuation of application No. PCT/NL99/00193, filed on Mar. 31, 1999.

(30) Foreign Application Priority Data

Apr. 1, 1998 (NL) ..... 1008784

(51) Int. Cl.[7] ..... A01G 5/00; A47G 7/00

(52) U.S. Cl. ..... 47/41.01; 47/41.15; 47/79; 47/83; 206/423

(58) Field of Search ..... 47/41.01, 82, 62, 47/59, 41.1, 41.11, 41.14, 41.15, 41.12, 83, 60, 79; 206/423

(56) References Cited

U.S. PATENT DOCUMENTS

| | | | | | |
|---|---|---|---|---|---|
| 4,802,304 | A | * | 2/1989 | Ferris | 47/41 R |
| 4,836,142 | A | * | 6/1989 | Duback | 119/5 |
| 4,884,364 | A | * | 12/1989 | Ferris | 47/41.01 |
| 4,887,388 | A | | 12/1989 | Waltel | |
| 5,044,118 | A | | 9/1991 | Ferris | |
| 5,095,649 | A | * | 3/1992 | Brownlee | 47/41.01 |
| 5,095,653 | A | * | 3/1992 | Guldberg | 47/83 |
| 5,146,709 | A | | 9/1992 | Iseki | |
| 5,367,823 | A | * | 11/1994 | Ferris | 47/39 |
| 5,440,836 | A | * | 8/1995 | Lee | 47/60 |
| D400,030 | S | * | 10/1998 | Wetzel | D6/474 |

FOREIGN PATENT DOCUMENTS

| | | | | |
|---|---|---|---|---|
| DE | 2803576 | | 8/1979 | |
| DE | 3835787 | A1 * | 4/1990 | A01G/5/06 |
| DE | 3904347 | A1 * | 8/1990 | A01G/9/02 |
| JP | 10-257944 | * | 9/1998 | |
| WO | WO 94/27424 | * | 12/1994 | A01G/5/06 |

* cited by examiner

*Primary Examiner*—Peter M. Poon
*Assistant Examiner*—Andrea Valenti
(74) *Attorney, Agent, or Firm*—Jones, Day, Reavis & Pogue

(57) ABSTRACT

Device for presenting fresh products, in particular (cut) flowers, provided with containers for the fresh products which are arranged one above another and filled with liquid, at least one of which containers accommodates a liquid overflow for draining liquid therein to an underlying container, with the special feature that the liquid overflow is formed at least substantially by an at least partially lowered side wall of the container.

7 Claims, 4 Drawing Sheets

DEVICE AND METHOD FOR PRESENTING FRESH PRODUCTS

This application is a continuation of International Application No. PCT/NL99/00193, filed Mar. 31, 1999 which claims the benefit of Netherlands Patent Application No. 1008784, filed Apr. 1, 1998.

BACKGROUND OF THE INVENTION

1. Field of the Invention

The invention relates to a device for presenting fresh products, in particular (cut) flowers, provided with containers for the fresh products which are arranged one above another and filled with liquid, at least one of which containers accommodates a liquid overflow for draining liquid therein to an underlying container. The invention also relates to a method for presenting fresh products making use of the device.

2. Description of the Related Art

Such a device is know from the American patent specification U.S. Pat. No. 5,367,823 (Ferris). The known device has open tray-like containers which are mounted parallel to and one above another in a frame and in which cut flowers are placed. Use is herein made of a closed liquid system wherein each container is filled to a desired liquid level and the excess liquid is subsequently drained via an overflow into an underlying container until this has also been filled to the desired liquid level, and so on. A pump on the bottom of the undermost container ensures that the liquid is carried from the undermost container through a flexible hose to the uppermost container to then be poured out again into the uppermost container and drained by means of the overflow thereof into the underlying container etc. In aforementioned flexible hose is also mounted a filter for cleaning the liquid, while an air cooling system is also provided.

A drawback of the device known from the above stated American patent publication is that the overflow used therein, in the form of a tube standing upright on the bottom of the container, can easily become blocked by dirt present in the liquid such as leaves, stem parts, flower parts, clotted flower nutrient additives, soil and so on. The quality of the flowers hereby deteriorates substantially during presentation, particularly because the blockage hampers replacement of the liquid and thus discharge of bacteria, so that bacteria growth occurs in the liquid of the container. The bacteria stimulate wilting of the flowers, which danger is increased because in practice flowers are often placed in liquid in which flowers have already stood and bacteria are therefore present. A customer also runs the risk of coming into contact with the dirty liquid. There is further an increased risk of the known device of the cut flowers being deprived of liquid because of the blockage, whereby a customer will have less time to enjoy them.

SUMMARY OF THE INVENTION

It is the object of the invention to obviate the drawbacks of the prior art and for this purpose the device of the type stated in the preamble has the special feature according to the invention that the liquid overflow is formed at least substantially by an at least partially lowered side wall of the container. In particular, the side wall is lowered along at least practically the entire width of the container. Blockage of the overflow is hereby prevented, wherein particularly floating parts such as leaves can be discharged easily and efficiently.

In a preferred embodiment of a device according to the invention the container accommodates a guide for guiding liquid drained via the at least partially lowered side wall to the underlying container. The guide preferably contains a wall part of the container with a sound-damping (plate-like) element on its underside, so that the liquid with the dirt possibly present therein reaches the underlying container without splashing and (further) contamination. The sound-damping element serves to minimize the sound of flowing liquid which is sometimes perceived as a nuisance.

In a further preferred embodiment of a device according to the invention the containers are arranged at least substantially parallel to and obliquely one above another. This not only enables a simple, rapid assembly of the containers but also ensures—owing to the sloping position of the containers relative to the horizontal—an effective functioning of the present overflow. In particular, the containers herein form an angle of about 40° to the horizontal. With such a cascade a greater flow speed of the liquid can further be achieved whereby dirt on which bacteria could grow can be carried along more easily. The bottoms of the containers are optionally also provided close to their lowered side walls with a lowered portion or recess or downward directed bulge. This lowered part functioning as a kind of displacement member ensures that stems of cut flowers present in an underlying container are pressed in the liquid.

A further preferred embodiment of a device according to the invention is embodied as a cabinet-like display-case. This results in an attractive "flower cabinet" functioning as display-case for the public, while a more controlled environment for the cut flowers is created in respect of air humidity and temperature. The air humidity should preferably be lower than 70%, more preferably between 60% and 70%.

A further preferred embodiment of a device according to the invention is provided with means for supplying liquid to the containers. This is preferably a closed circulation system for the liquid.

A further preferred embodiment of a device according to the invention contains means for cleaning liquid drained from the container(s), particularly while making use of ultraviolet radiation. It is recommended to make use of ultraviolet radiation with a wavelength lying between 250–270 nm. The shelf-life of the flowers can thus be further improved, which can be optimized even further by cooling the air in the device embodied as display-case.

It is noted that within the scope of the invention the above used term "liquid" is particularly understood to mean "water", which may or may not be supplemented with flower nutrient additives. Container is understood to mean in this respect a container of water-resistant material suitable for receiving at least one flower and preferably at least one bunch of flowers.

The invention also relates to a method for presenting fresh products, particularly (cut) flowers, making use of containers for the fresh products which are arranged one above another and filled with liquid, at least one of which containers accommodates a liquid overflow for draining liquid therein to an underlying container, with the special feature that the liquid overflow is formed at least substantially by an at least partially lowered side wall of the container. To improve the shelf-life of the flowers still further, clean, cooled liquid (water) is added to cool the flowers, wherein a closed liquid circulation system is recommended.

BRIEF DESCRIPTION OF THE DRAWINGS

The invention will now be elucidated with reference to a preferred embodiment according to the invention as shown in a drawing, in which.

DETAILED DESCRIPTION OF THE PREFERRED EMBODIMENTS

Figure 1:
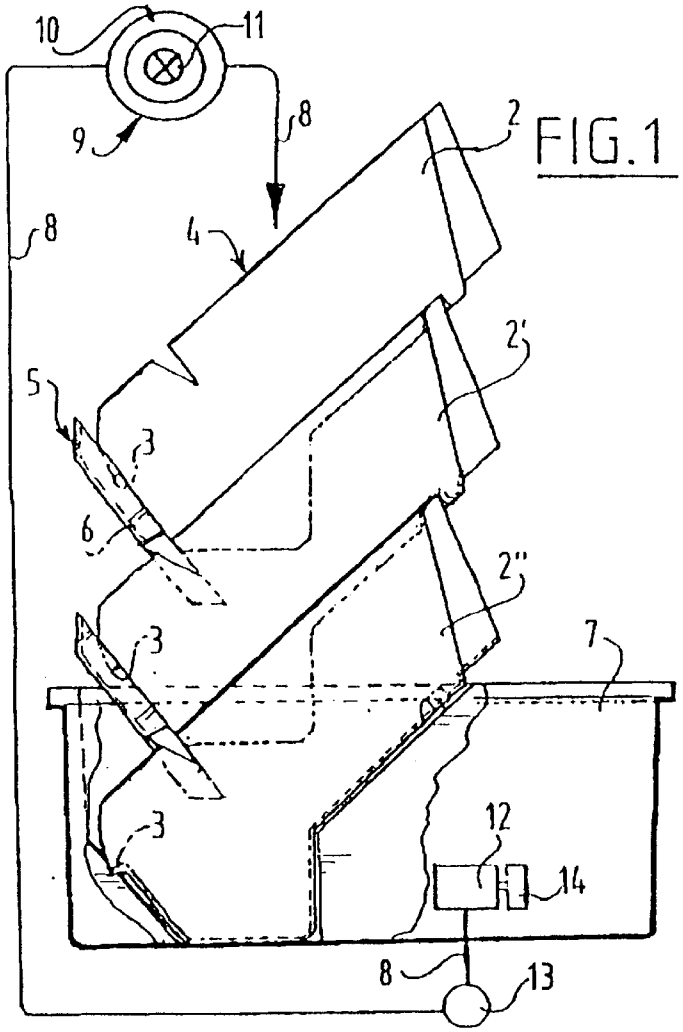
FIG. 1 shows a cross-section of a device for presenting flowers.
Figure 5:
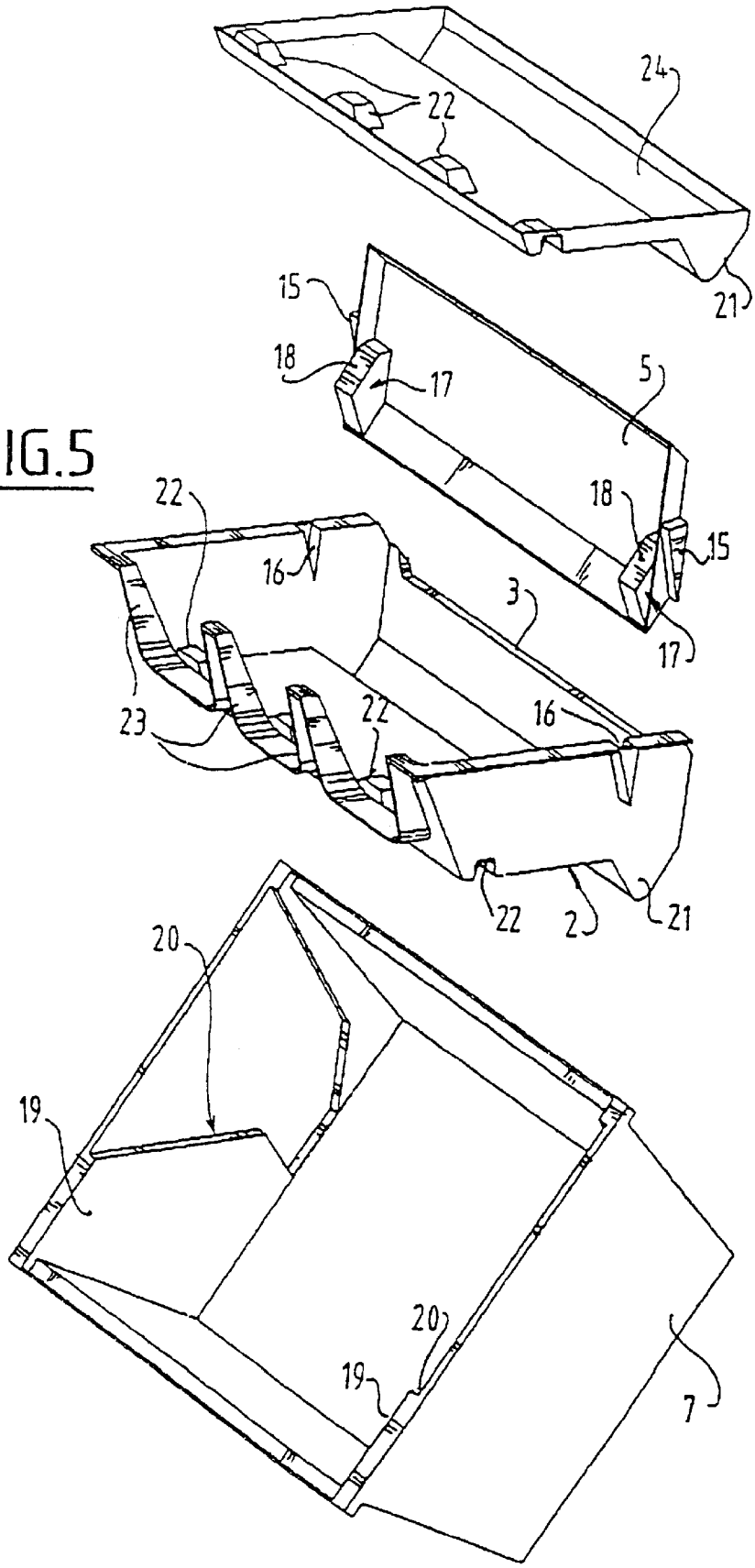
FIG. 5 shows in perspective diverse components of the device of FIGS. 2–4.

FIG. 1 shows in a side view and in cross-section a device 1 comprising three containers 2, 2', 2" for receiving (bouquets of) flowers. Since the bouquets are directed toward the shopping public, they get a good impression of the flowers, while a large number of bouquets is shown on a relatively small surface area. Each container is open at the top and provided with an overflow wall 3. Overflow wall 3 is formed as a water threshold by an upper recess in the rear wall of each container 2, 2', 2", so that in other words there is a lowered rear wall thereof across the entire width of each container 2, 2', 2". Clean water is supplied via opening 4 and enters container 2. Possibly dirty water drained from the container leaves by flowing over the overflow wall 3 and flows along a wall plate 5 functioning as a water guide into underlying container 2'. Wall plate 5 functioning as a water guide is fixed as a separate part relative to the container 2, this as shown in FIG. 5. In another preferred variant the wall part is manufactured integrally with container 2 by means of injection moulding. If it is desired to minimize the sound of flowing water, a sound-damping element 6 such as a plate can be provided, along which the water flows into container 2'. The plate-like sound-damping element 6 is here manufactured integrally with the wall plate 5 and is set inward over the entire length thereof.

In corresponding manner possibly fouled water flows out of containers 2' and 2" and enters a collecting tank 7. In the embodiment shown here collecting tank 7 is connected via a conduit 8 to a cleaning or disinfecting unit 9 functioning as through-flow unit, which cleaning unit comprises a double-walled tube 10, for instance of quartz glass, in which a UV lamp 11 is arranged. UV lamp 11 radiates bacteria-killing light, suitably at a wavelength of 250–270 nm. Transport of water from collecting tank 7 takes place in appropriate manner with a pump 12 present therein whereby the water carried through tube 10 and cleaned/disinfected under the influence of UV is fed back as clean water into container 2 via opening 4.

The device is preferably provided with a cooling unit 13 which is placed for instance after pump 12. Circulation of constantly cooled water increases the shelf-life of the cut flowers. In another preferred variant, which may or may not be combined with cooling of the water, means are provided for cooling the air in the device, which likewise results in an extended shelf-life.

In such a case the device is suitably enclosed on all sides by walls with doors on the front side, in particular doors manufactured from transparent material such as glass or plastic, whereby a "flower cabinet" is formed. A more controlled environment is hereby created for the cut flowers, wherein a suitable air humidity and a lower temperature contribute toward an extended shelf-life. The air humidity is in particular lower than 70%.

Figure 3:
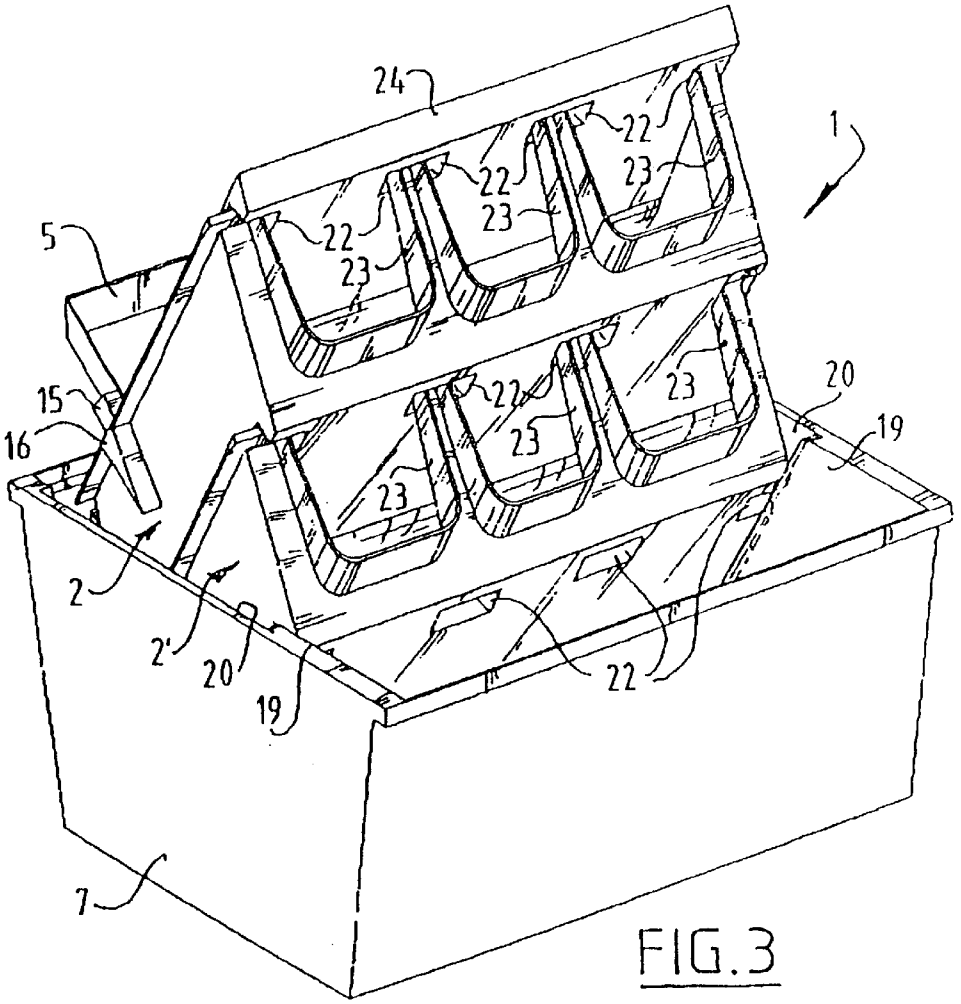
FIG. 2, FIG. 3 respectively FIG. 4 show in perspective a schematic top view, front view respectively (partly cut-away) side view of the device of FIG. 1 with containers used therein.
Figure 2:
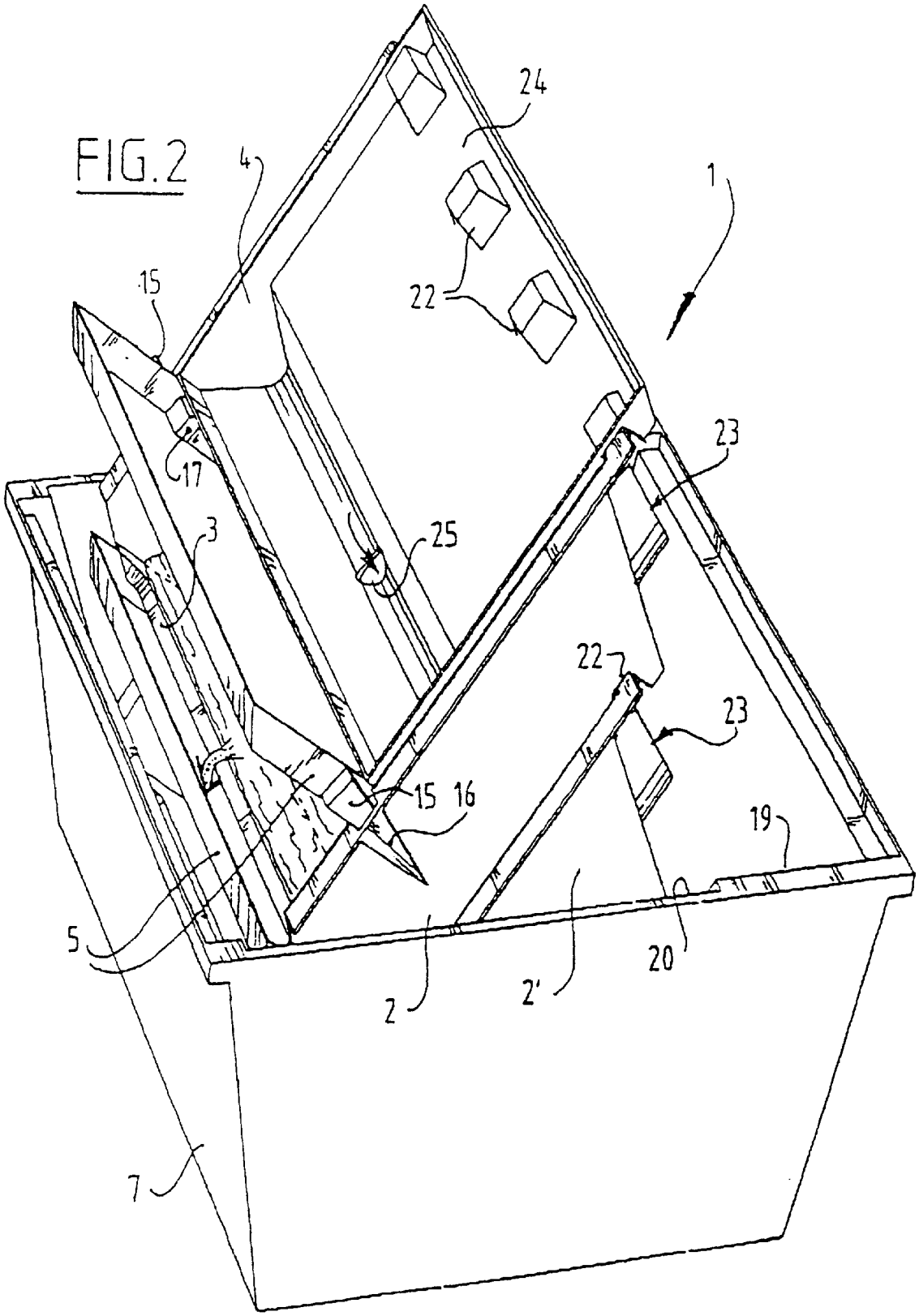
Figure 4:
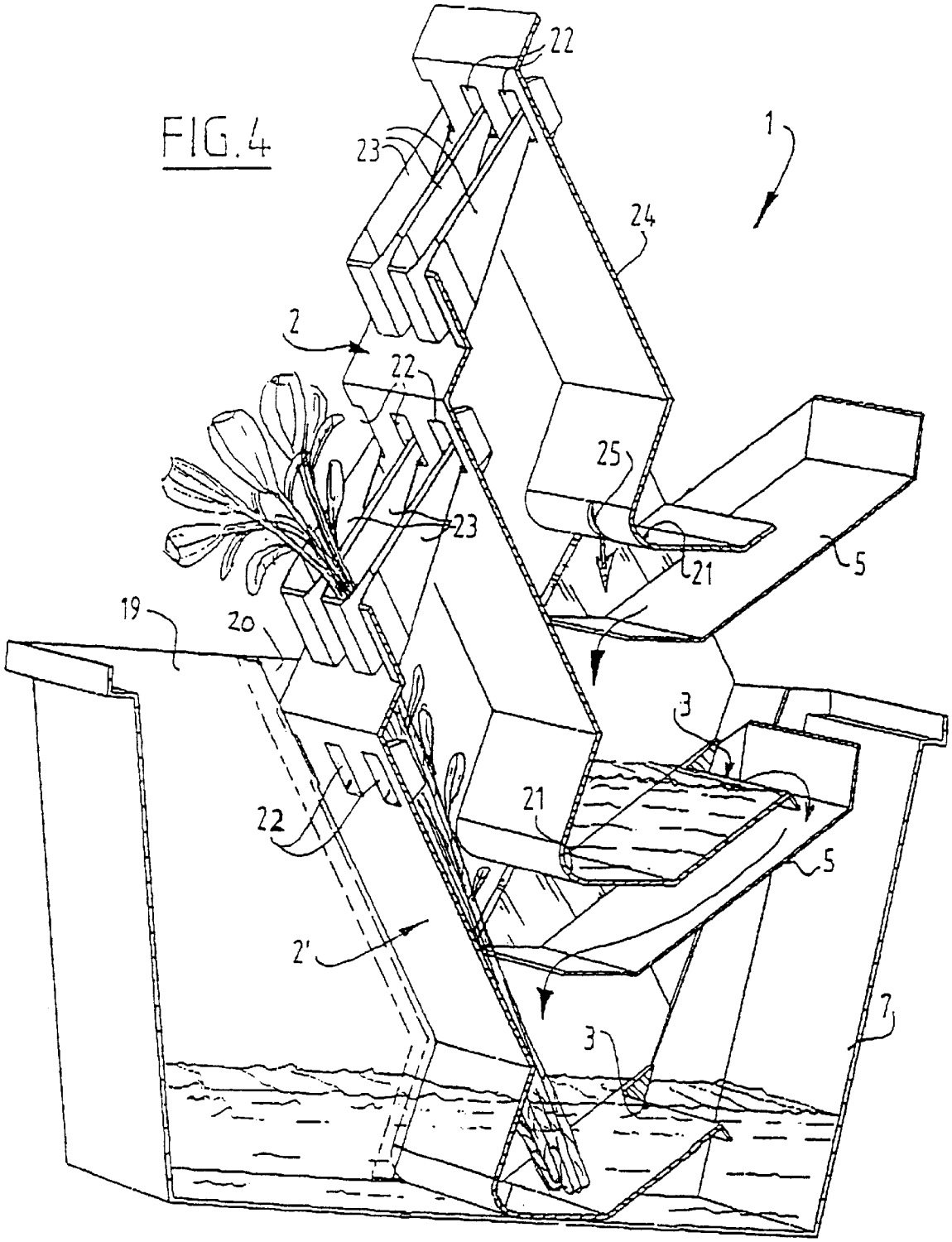

FIG. 2, FIG. 3 and FIG. 4 relate respectively to a perspective and schematic top view, front view and (partly cut-away) side view of the device of FIG. 1 with containers used therein, two of which containers 2, 2' are drawn in this case. Components corresponding with those of previous figures are designated with the same reference numerals. As FIG. 5 shows, water guiding wall plate 5 is embodied here as separate plate which can be fixed relative to containers 2, 2'. For this purpose the wall plate 5 has substantially wedge-shaped profiles 15 on either side which in mounted position (see FIGS. 2 and 3) fit clampingly into the correspondingly formed recesses 16 in the side wall of containers 2, 2'. The wall plate 5, functioning as a water guide, has close to profiles 15 two projections or shoulders 17 on the chamfered surface 18 with which an upper-lying container can support on an underlying container.

In the mounted situation drawn in FIGS. 2–4 the whole unit of containers is held in position by fixation means situated in collecting tank 7 in the form of a profiling 20 arranged in mutually opposite side walls 19 thereof. The above mentioned bulge serving as displacement member is designated with 21. Bulge 21 partly brings about that the stems of cut flowers present in the container located thereunder are pressed into the water. In the embodiment shown here overflow 3 is embodied over at least practically the full width of the containers, whereby floating parts such as leaves can be discharged rapidly and effectively. It is noted that each container 2 has a number of recesses 22 into which legs 23 of an underlying container 2' are placed fittingly in the mounted position. Finally, FIG. 5 shows a cover 24 which likewise contains recesses 22 for legs 23 of underlying container 2. The cover otherwise has a hole 25 through which water can flow from above into underlying container 2.

It will be apparent to the skilled person that diverse variations of the described invention are possible within the scope of the appended claims. As stated therefore, the air can also be cooled and this may or may not be instead of cooling the water. In order to prevent blockage of conduits by solid particles in the contaminated water the openings are given a large form and provided with filter means 14 whereby for instance loose leaves cannot block the drain, as will be apparent to the skilled person.

What is claimed is:

1. A display apparatus for fresh products comprising:

a first row of containers having a width and being arranged in an oblique disposition, each container of said first row of containers having a front opening, a liquid reservoir and a rear wall with a top edge, said top edge being lower in elevation than said opening;

a first guide wall arranged in an oblique disposition opposite to the disposition of said first row of containers and having a width about equal to the width of said first row of containers, said first guide wall position to receive liquid flowing over said top wall of said rear wall of each container of said first row of containers;

a second row of containers having a width and being arranged in an oblique disposition like that of said first row of containers and at a lower elevation than said first row of containers, each container of said second row of containers having a front opening, a reservoir and a rear wall with a top edge, said top edge of each container of said second row of containers being lower in elevation then said opening of each container of said second row of containers;

a second guide wall arranged in an oblique disposition like that of said first guide wall and having a width about equal to the width of said second row of containers, said second guide wall position to receive liquid flowing over said top edge of said rear wall each container of said second row of containers;

a collection tank at an elevation lower than the opening of each container of said second row of containers;

a pump mounted connected to said tank; and a conduit for transporting liquid from said tank to flow to said reservoir of each container of said first row of containers wherein the liquid receive by said reservoir of each container of said first row of containers flows over said top edge of said rear wall of each container of said first row of containers and drops to said first guide wall, said liquid flowing along said first guide wall before dropping to said reservoir of each container of said second row of containers, each container of said first and said second rows of containers adapted to receive fresh products through said front opening wherein a portion of said fresh products are disposed in said reservoir, said liquid flowing over the top edge of said rear wall of each container of said second row of containers and dropping to said second guide wall, said liquid flowing along second guide wall and thereafter dropping into said tank.

2. The display apparatus as claimed in claim 1 including:

means for cleaning liquid pumped from said tank.

3. The display apparatus as claimed in claim 2 including:

means for cooling liquid pumped from said tank.

4. The display apparatus as claimed in claim 3 wherein:

said tank includes shoulders for supporting rows of containers.

5. A method for displaying fresh products comprising the steps of:

providing a liquid holding tank;

providing a pump in operative communication with said tank;

providing a conduit connected to said pump;

transporting liquid in said conduit from said tank to a first reservoir of an obliquely disposed first container;

forming a first reservoir for receiving fresh products;

forming a first rear wall with a first top edge about equal in width to said first container;

flowing said liquid from said first reservoir over the full width of said first top edge;

forming an oppositely disposed oblique first guide wall for receiving the liquid flowing over said first top edge;

flowing the liquid to a second reservoir of an obliquely disposed second container at a lower elevation then said first container;

forming a second reservoir for receiving fresh products;

forming a second rear wall with a second top edge about equal in width to said second container;

flowing said liquid from said second reservoir over the full width of said second top edge;

forming an oppositely disposed oblique second guide wall for receiving the liquid flowing over the second top edge; and thereafter flowing the liquid to said tank.

6. The method as claimed in claim 5 including the step of:

cleaning the liquid.

7. The method as claimed in claim 6 including the step of:

cooling the liquid.

* * * * *